US006192780B1

(12) United States Patent
Schneider

(10) Patent No.: US 6,192,780 B1
(45) Date of Patent: Feb. 27, 2001

(54) FORWARD RECEIVER BUFFER

(76) Inventor: Bryan S. Schneider, 1625 Hathaway Dr., Colorado Springs, CO (US) 80915

( * ) Notice: Subject to any disclaimer, the term of this patent is extended or adjusted under 35 U.S.C. 154(b) by 0 days.

(21) Appl. No.: 09/277,865

(22) Filed: Mar. 29, 1999

(51) Int. Cl.[7] ..... F41A 5/00; F41C 5/00; F41F 5/00

(52) U.S. Cl. ..... 89/198; 89/44.02

(58) Field of Search ..... 89/198, 199, 177, 89/44.02, 44.01, 42.01

(56) References Cited

U.S. PATENT DOCUMENTS

| | | | | |
|---|---|---|---|---|
| 3,568,565 | * | 3/1971 | Swieskowski | 89/199 |
| 3,580,132 | * | 5/1971 | Vartanian | 89/130 |
| 3,656,400 | * | 4/1972 | Stoner et al. | 89/138 |
| 3,756,121 | * | 9/1973 | Roy | 89/196 |
| 4,183,510 | * | 1/1980 | Kontis | 267/70 |
| 4,335,644 | * | 6/1982 | Goes et al. | 89/198 |
| 4,514,921 | * | 5/1985 | Burkleca | 42/1.06 |
| 4,558,628 | * | 12/1985 | Bosshard | 89/198 |
| 4,754,689 | * | 7/1988 | Grehl | 89/196 |
| 4,827,829 | * | 5/1989 | Stoner | 89/43.01 |
| 5,056,410 | * | 10/1991 | Pitts | 89/37.04 |
| 5,581,046 | * | 12/1996 | Weldle et al. | 89/196 |
| 5,909,002 | * | 6/1999 | Atchisson | 89/130 |

FOREIGN PATENT DOCUMENTS

| | | | |
|---|---|---|---|
| 3612098 | * | 10/1986 | (DE) . |
| 3911280 | * | 11/1990 | (DE) . |
| 2043845 | * | 10/1980 | (GB) . |

* cited by examiner

*Primary Examiner*—Peter M. Poon
*Assistant Examiner*—Judith A. Nelson
(74) *Attorney, Agent, or Firm*—G. F. Gallinger

(57) ABSTRACT

Positioned on a rear portion of a front receiver lug post on a gun so that when the bolt carrier springs forward the impact of the bolt carrier striking and abruptly stopping against the receiver lug post will be minimized. The forward receiver buffer comprises, an elongate attachment member having an attachment arm on a front end portion and, a shock absorption block attached to the rear end portion of the elongate attachment member. In use the receiver buffer is pressed over the lug post on the receiver of the gun so that the shock absorption block covers a rear end portion of the lug post. In a preferred aspect of this invention the gun has a bolt cover and the attachment member comprises a thin strip so that when it is operatively positioned laterally over the lug post the cover may enclose and hold the attachment member.

8 Claims, 1 Drawing Sheet

FORWARD RECEIVER BUFFER

FIELD OF INVENTION

This invention relates to reducing the impact between a bolt carrier and a receiver on a gun. More particularly this invention relates to a buffer which is designed to be positioned on a rear portion of a front receiver lug post on the gun so that when the bolt carrier springs forward the impact of the bolt carrier striking and abruptly stopping against the receiver lug post will be minimized.

BACKGROUND OF THE INVENTION

In the AK47 and AKM family of semi-automatic Kalashnikov family of rifles the bolt carrier has a substantial mass. When it is blown back a substantial portion of its energy is absorbed by a long coiled spring. Any excess energy is dissipated on an impact area on the rear receiver of the gun. When the bolt carrier slides forward it is accelerated by the long coiled spring. All of its forward momentum is dissipated at the end of the forward stroke when it strikes and abruptly stops against the forward receiver post.

Others have recognized the need to cushion the impact between the steel bolt carrier and the steel receiver. Providing cushioning therebetween will quieten operation and extend the life of the gun. One solution has been to provide for a cushion insert positioned over the coiled spring, which extends downwardly immediately in front of the impact area on the rear receiver. While this protects the rear receiver, it does nothing to protect the smaller lug post on the forward receiver. Something is needed to protect the lug post and the bolt carrier when they strike each other.

OBJECTS AND STATEMENT OF INVENTION

It is an object of this invention to disclose a means to protect a lug post on the forward receiver of a gun from abrupt impact received when the bolt carrier abruptly stops thereon. It is an object of this invention to extend the life of a firearm. It is yet a further object of this invention to disclose a means of positioning and maintaining a shock absorption buffer adjacent to a rear portion of the forward lug post on the receiver of a gun to cushion the abrupt stop of the bolt carrier against it.

One aspect of this invention provides for a forward receiver buffer for cushioning the impact of a bolt carrier against the lug post on the forward receiver of a gun comprising: an elongate attachment member having an attachment arm on a front end portion and a shock absorption block attachment means on an opposite rear end portion thereof; and, a shock absorption block attached to be rear end portion of the elongate attachment member. In use the receiver buffer is pressed over the lug post on the receiver of the gun so that the shock absorption block covers a rear end portion of the lug post.

Another aspect of this invention provides for a forward receiver buffer as above wherein the gun has a receiver cover and wherein the attachment member comprises a thin strip so that when it is operatively positioned laterally over the lug post the cover may enclose the attachment member.

Various other objects, advantages and features of novelty which characterize this invention are pointed out with particularity in the claims which form part of this disclosure. For a better understanding of the invention, its operating advantages, and the specific objects attained by its users, reference should be made to the accompanying drawings and description, in which preferred embodiments of the invention are illustrated.

FIGURES OF THE INVENTION

The invention will be better understood and objects other than those set forth will become apparent to those skilled in the art when consideration is given to the following detailed description thereof. Such description makes reference to the annexed drawings wherein.

Figure 1:
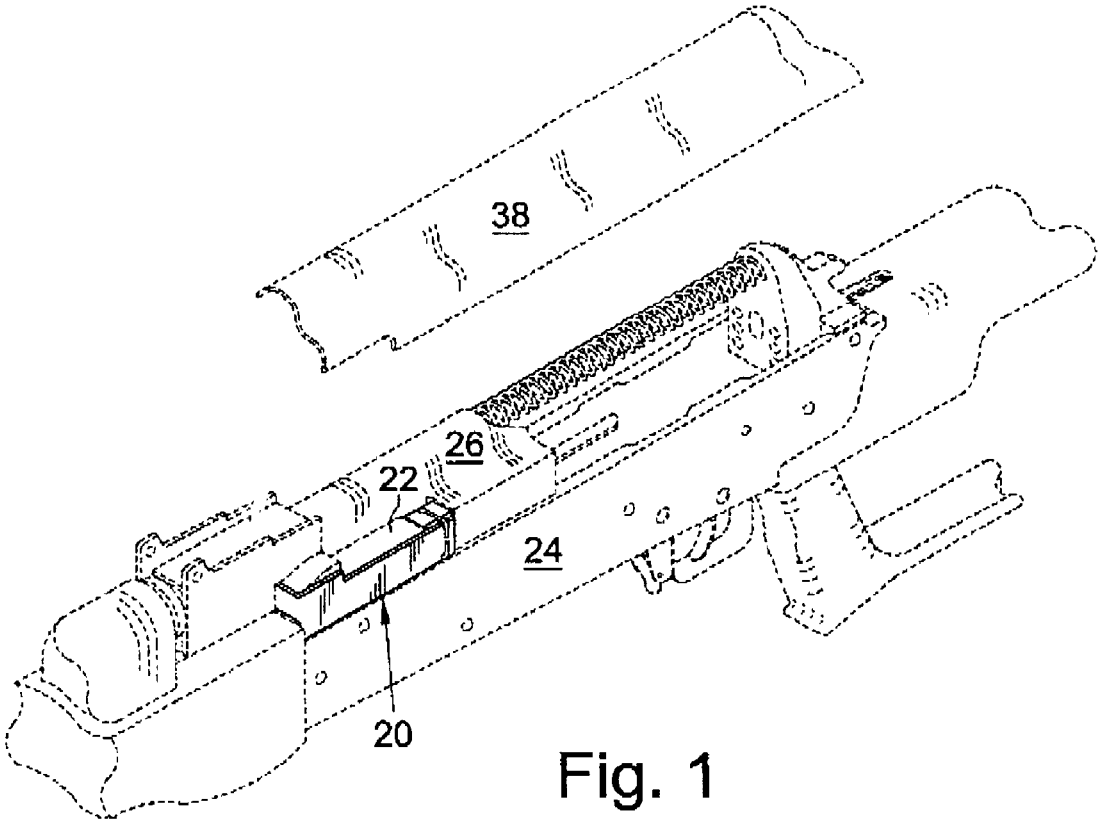
FIG. 1 is a perspective view of a forward receiver buffer positioned on a front receiver lug post on a gun.

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

DESCRIPTION OF THE INVENTION

Turning now to the drawings and more particularly to FIG. 1 we have a perspective view of a forward receiver buffer 20 positioned on a front receiver lug post 22 on a gun 24. The forward receiver buffer 20 cushions the impact of a bolt carrier 26 against the lug post 22 on the forward receiver 26 of a gun 24.

Figure 2:
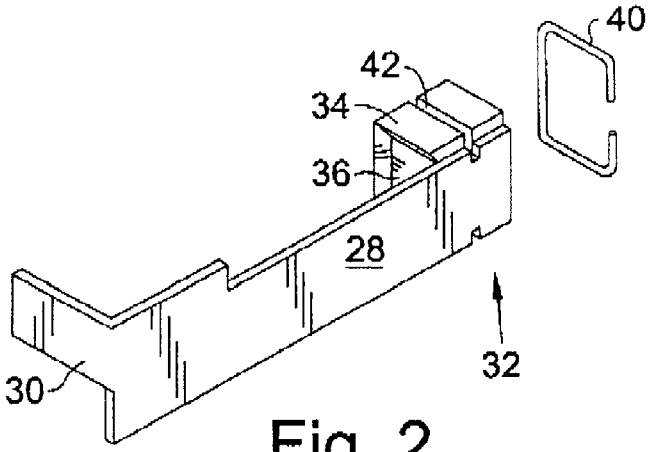
FIG. 2 is an enlarged perspective view of the forward receiver buffer shown in FIG. 1.

FIG. 2 is an enlarged perspective view of the forward receiver buffer 20 shown in FIG. 1. The forward receiver buffer 20 comprises: an elongate attachment member 28 having an attachment arm 30 on a front end portion and a shock absorption block attachment means 32 on an opposite rear end portion thereof; and, a shock absorption block 34 attached to be rear end portion of the elongate attachment member 28. In use the receiver buffer is laterally pressed over the lug post 22 on the receiver 26 of the gun 24 so that the shock absorption block 34 covers a rear end portion of the lug post 22.

FIG. 2 shows how a front face 36 of the shock

FIG. 2 shows how a front face 36 of the shock absorption block 34 is shaped to mate with a rear end portion of the lug post 22. Most preferably the block 34 is made of a polyurethane rubber or soft shock absorbing plastic. FIG. 1 shows the gun 24 having a receiver cover 38 which slides downwardly over the bolt carrier 26. Most preferably the attachment member 28 comprises a thin metallic strip so that when it is operatively positioned on the lug post 22 the cover 38 may enclose the attachment member 28 positioned on and over the lug post 22. When the attachment member 28 is slid laterally over the lug post 22 the cover 38 will additionally help maintain it in a correct operative position.

FIG. 2 also shows a preferred attachment means 32. The attachment means 32 comprises a clip 40 which seats in a partial lateral peripheral groove 42 around the block 34 so that the block 34 may be held adjacent to the rear end portion of the attachment member 28.

Figure 3:
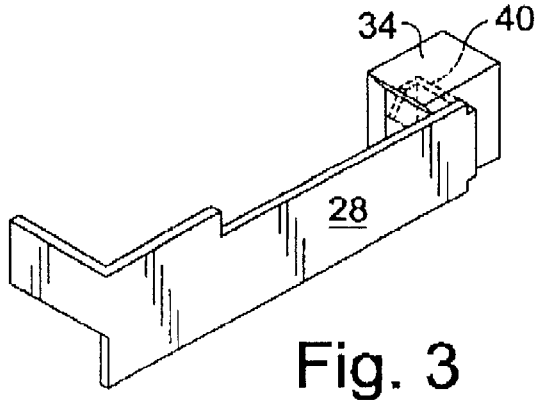
FIG. 3 is an enlarged perspective view of the forward receive buffer showing an alternative means of attaching the rubber block thereto.

FIG. 3 shows another preferred attachment means 32. In this preferred embodiment the attachment member is a metallic strip 28 having a clip 40 which may pass through the block 34 and then fold over a side of the block 34 opposite the metallic strip 28 thereby securing the block 34 to the attachment means 32. Yet another preferred attachment means 32 comprises a nut and bolt (neither shown).

While the invention has been described with preferred specific embodiments thereof, it will be understood that this description is intended to illustrate and not to limit the scope of the invention. The optimal dimensional relationships for all parts of the invention are to include all variations in size, materials, shape, form, function, assembly, and operation, which are deemed readily apparent and obvious to one skilled in the art. All equivalent relationships to those illustrated in the drawings, and described in the specification, are intended to be encompassed in this invention. What is desired to be protected is defined by the following claims.

I claim:

1. A forward receiver buffer for cushioning the impact of a bolt carrier against the lug post on the forward receiver of a gun comprising, in combination:

an elongate attachment member having an attachment arm on a front end portion and a shock absorption block attachment means on an opposite rear end portion thereof; and, a shock absorption block attached to the rear end portion of the elongate attachment member;

where in use the receiver buffer is pressed over the lug post on the receiver of the gun so that the shock absorption block covers a rear end portion of the lug post.

2. A buffer as in claim 1 wherein a front face of the shock absorption block is shaped to mate with a rear end portion of the lug post.

3. A buffer as in claim 2 wherein the gun has a receiver cover and wherein the attachment member comprises a thin strip so that when it is operatively positioned on the lug post the cover may enclose the attachment member positioned on the lug post.

4. A buffer as in claim 3 wherein the buffer is adapted to laterally slide over the lug post so that the cover will additionally maintain it in an operative position.

5. A buffer as in claim 4 wherein the strip is metallic.

6. A buffer as in claim 5 wherein the block has a partial lateral peripheral groove therearound and wherein the attachment means comprises a clip which seats in the groove to hold the block to the rear end portion of the attachment member.

7. A buffer as in claim 5 wherein the rear end portion of the metallic strip comprises a tab which may pass through the block and then fold over a side of the block opposite the metallic strip.

8. A buffer as in claim 5 wherein the shock absorption block is made of polyurethane rubber.

* * * * *